United States Patent [19]

Ofusa et al.

[11] Patent Number: 4,915,140

[45] Date of Patent: Apr. 10, 1990

[54] WOVEN SLIDE FASTENER STRINGER

[75] Inventors: Masaatsu Ofusa, Kurobe; Muchiji Shimono, Namerikawa, both of Japan

[73] Assignee: Yoshida Kogyo K. K., Tokyo, Japan

[21] Appl. No.: 322,494

[22] Filed: Mar. 13, 1989

[30] Foreign Application Priority Data

Mar. 22, 1988 [JP] Japan ..... 63-37325

[51] Int. Cl.[4] ..... A44B 19/10

[52] U.S. Cl. ..... 139/384 B; 24/393

[58] Field of Search ..... 139/384 B; 24/392, 393

[56] References Cited

U.S. PATENT DOCUMENTS

| | | | |
|---|---|---|---|
| 4,215,729 | 8/1980 | Ofusa | 139/384 B |
| 4,383,558 | 5/1983 | Tsubata et al. | 139/384 B |
| 4,498,503 | 2/1985 | Ofusa | 139/116 |
| 4,561,474 | 12/1985 | Ofusa | 139/384 B |
| 4,597,418 | 7/1986 | Ofusa | 139/384 B |
| 4,623,004 | 11/1986 | Matsushima et al. | 139/384 B |
| 4,678,013 | 7/1987 | Ofusa et al. | 139/384 B |
| 4,682,635 | 7/1987 | Ofusa et al. | 139/116 |

FOREIGN PATENT DOCUMENTS

| | | |
|---|---|---|
| 0121116 | 10/1984 | European Pat. Off. . |
| 0139284 | 5/1985 | European Pat. Off. . |
| 0143463 | 6/1985 | European Pat. Off. . |
| 1167578 | 4/1964 | Fed. Rep. of Germany . |
| 2027117 | 2/1980 | United Kingdom . |

*Primary Examiner*—Henry S. Jaudon

*Attorney, Agent, or Firm*—Hill, Van Santen, Steadman & Simpson

[57] ABSTRACT

A woven slide fastener stringer is disclosed, which comprises a woven support tape and a row of continuous coupling elements woven into a longitudinal edge of the tape. The coupling elements are securely anchored in place by a minimum number of binding warp threads and a plurality of clamping warp threads which form a cross-sectionally triangular weave structure designed to ensure firm holding of the coupling elements on the tape.

4 Claims, 2 Drawing Sheets

WOVEN SLIDE FASTENER STRINGER

BACKGROUND OF THE INVENTION

1. Field of the Invention

This invention relates to a woven slide fastener stringer having a row of continuous filamentary coupling elements woven integrally into a woven fabric tape, and more particularly to such a fastener stringer of reduced dimension which is suitable for use on miniature garment articles such as clothes, underwear and other fabric strips for dolls and the like.

2. Prior Art

A chain of coupling elements woven into a support tape in common use has a width typically in the range of 5–6 mm, whereas this chain width for application to miniature articles as contemplated under the invention is required to be as small as about 2.5 mm. In order to affix such small coupling elements securely to the tape edge, it would be literally necessary to use a sufficient number of binding warp threads to anchor the coupling elements in place so that the slide fastener can withstand stresses applied during repeated opening and closing operation of the slider. However, an increase in the number of warp threads in the tape edge at which the coupling elements are woven would result in reduced dimension or depth of the individual elements on one tape available for engagement with corresponding elements in the other or mating tape. Conversely reducing the number of warp binding threads would lead to reduced positional stability of the coupling elements on the tape.

SUMMARY OF THE INVENTION

With the foregoing difficulties in view, the present invention seeks to provide a slide fastener stringer of a woven type which incorporates structural features whereby a chain of miniature coupling elements can be stably affixed to the tape edge whilst maintaining sufficient coupling strength of the chain. This and other objects and advantages of the invention will be better understood from reading the following detailed description with reference to the accompanying drawings.

According to the invention, there is provided a woven slide fastener stringer comprising: a woven stringer tape having a web portion and a longitudinal edge portion; a row of continuous filamentary coupling elements disposed on the longitudinal edge portion and each including a head portion, a pair of superimposed upper and lower leg portions and a heel portion; and an element anchoring weave system anchoring the row of coupling elements in place on the tape edge and comprising an upper clamping warp thread extending substantially in a straight run over substantially a midpoint of the upper leg portion, a first lower clamping warp thread extending substantially in a straight run under substantially a midpoint of the lower leg portion, a second lower clamping warp thread extending substantially in a straight run under the lower leg portion immediately adjacent to the heel portion, an anchoring weft thread extending from the tape web portion and interlacing with the three clamping warp threads to form a substantially triangular thread structure, and a plurality of binding warp threads alternately overlying and underlying the row of coupling elements between the upper clamping thread and the second lower clamping thread and interlacing with the anchoring weft thread.

DETAILED DESCRIPTION OF THE PREFERRED EMBODIMENT

Figure 1:
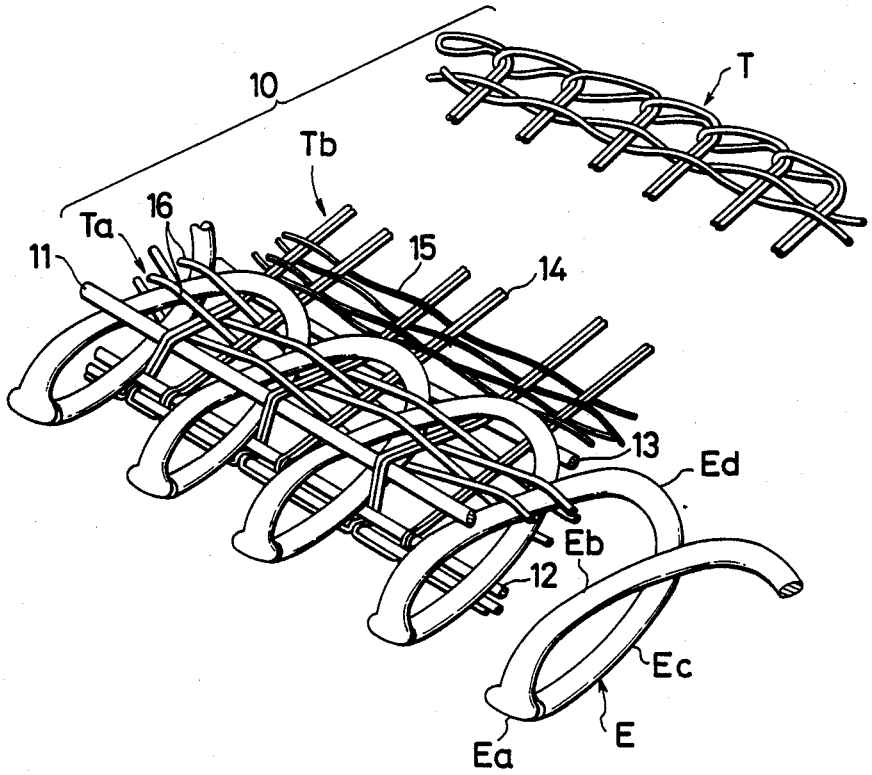
FIG. 1 is a perspective view on enlarged scale of a fragment of a slide fastener stringer embodying the invention.

Referring now to the drawings and FIG. 1 in particular, there is shown a fragmentary portion of a woven slide fastener stringer 10 which comprises a row of continuous coupling elements E woven into a longitudinal edge portion Ta of a support tape T simultaneously with weaving of a tape web portion Tb. The row of coupling elements E is formed from a thermoplastic monofilamentary material such as nylon and polyester which is laid in as a double pick of weft and woven integrally with yarns constituting a woven tape. The monofilament is coiled into successive individual coupling elements E at the tape edge Ta and pressed from both sides to provide a coupling head portion Ea projecting beyond the tape edge Ta, the monofilament being bifurcated from the coupling head Ea to provide a pair of leg portions Eb, Ec substantially in superposed relation, which leg portions Eb, Ec turn around respective heel portions Ed and merge into adjacent coupling elements E. This construction is well known in the art and hence will require no further explanation. A pair of these fastener stringers 10 when coupled together form a continuous chain to be assembled with end stops and sliders as is also well known. Designated at 11 is an upper clamping warp thread extending longitudinally substantially in a straight run over substantially a midpoint of each of the upper leg portions Eb of successive coupling elements E. A first lower clamping thread 12 extends substantially in a straight run under substantially a midpoint of each of the lower leg portions Ec. A second lower clamping thread 13 extends also substantially in a straight run under lower leg portions Ec immediately adjacent to the heel portions Ed of successive coupling elements E.

Figure 2:
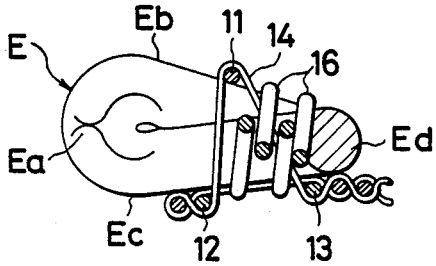
FIG. 2 is a transverse cross-sectional view of the same.
Figure 3:
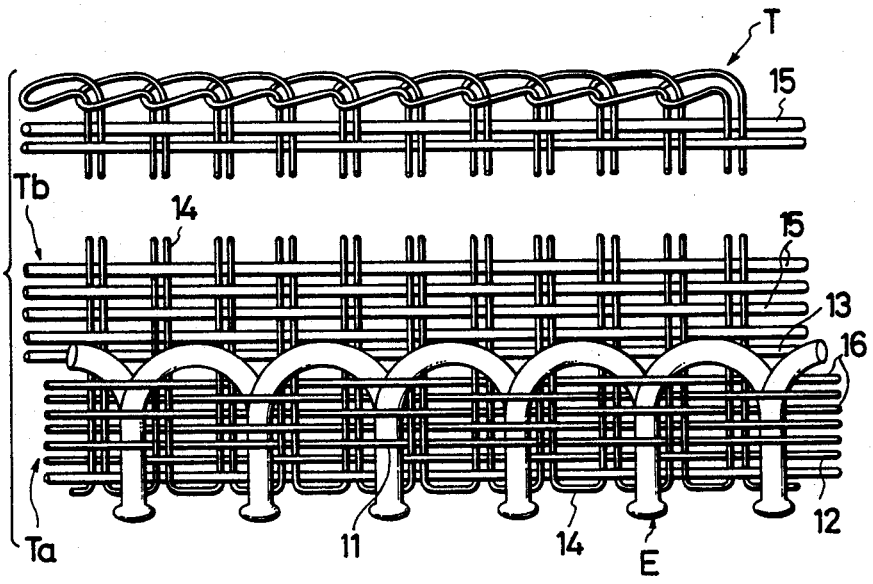
FIG. 3 is a plan view of the same.
Figure 4:
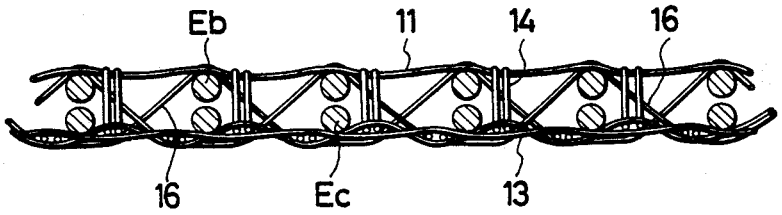
FIG. 4 is a longitudinal cross-sectional view of the same.

According to an important aspect of the invention, the three clamping threads 11, 12 and 13 are arranged geometrically in such positions that anchoring weft threads 14 extending from the tape web Tb form a substantially triangular structure as they pass around and interlace with clamping threads 11, 12 and 13 as shown in FIG. 2. This triangular thread structure provides increased strength of anchoring the elements E in the tape T and compensates for fewer binding warp threads 16 than would otherwise be required. The anchoring weft threads 14 woven in double picks as on a needle-loom are interlaced with warp threads 15 to form the tape web portion Tb, as better shown in FIG. 3. A plurality of binding warp threads 16, four in number in the case of FIG. 1, alternately overlie the upper legs Eb of elements E and underlie the lower legs Ec and extend between the upper clamping thread 11 and the second lower clamping thread 13 as better shown in FIG. 2. The binding warp threads 16 are interlaced with the anchoring weft threads 14 to hold the coupling elements E firmly in place against movement. The fewer the binding warp threads 16, the larger dimension or depth will be for mutual coupling engagement of the coupling elements E. However, it has been found that at least two of these binding threads 16 are required to eliminate the tendency of the coupling elements E to shift or move out of alignment with respect to the support tape T.

What is claimed is:

1. A woven slide fastener stringer comprising:

(a) a woven stringer tape having a web portion and a longitudinal edge portion;

(b) a row of continuous filamentary coupling elements disposed on said longitudinal edge portion and each including a head portion, a pair of superimposed upper and lower leg portions and a heel portion; and (c) an element anchoring weave system anchoring said row of coupling elements in place on the tape edge and comprising an upper clamping warp thread extending substantially in a straight run over substantially a midpoint of said upper leg portion, a first lower clamping warp thread extending substantially in a straight run under substantially a midpoint of said lower leg portion, a second lower clamping warp thread extending substantially in a straight run under said lower leg portion immediately adjacent to said heel portion, an anchoring weft thread extending from said tape web portion and interlacing with said three clamping warp threads to form a substantially triangular thread structure, and a plurality of binding warp threads alternately overlying and underlying said row of coupling elements between said upper clamping thread and said second lower clamping thread and interlacing with said anchoring weft thread.

2. A woven slide fastener stringer according to claim including at least two of said binding warp threads.

3. A woven slide fastener stringer according to claim 1 wherein said anchoring weft thread is woven in double picks.

4. A woven slide fastener stringer according to claim wherein a chain width of said coupling elements is about 2.5 mm.

* * * * *